United States Patent [19]

Beischer

[11] Patent Number: 4,719,403

[45] Date of Patent: Jan. 12, 1988

[54] R. F. GLOW DISCHARGE CONSTANT CURRENT SOURCE

[75] Inventor: Philip F. Beischer, Florham Park, N.J.

[73] Assignee: The BOC Group, Inc., Montvale, N.J.

[21] Appl. No.: 926,279

[22] Filed: Nov. 3, 1986

[51] Int. Cl.[4] ..... G05F 1/10

[52] U.S. Cl. ..... 323/234; 315/307; 356/316; 356/417; 363/97

[58] Field of Search ..... 363/97; 315/248, 307, 315/308; 356/311, 313, 316, 417; 323/280, 365, 234

[56] References Cited

U.S. PATENT DOCUMENTS 2,967,451 1/1961 Farrall ..... 356/316

4,356,433 10/1982 Linden ..... 315/208

*Primary Examiner*—William H. Beha, Jr.

*Attorney, Agent, or Firm*—Chris P. Konkol; R. Hain Swope; Larry R. Cassett

[57] ABSTRACT

A constant current source for maintaining an essentially constant current flow through an r. f. glow discharge reaction occurring in a reactor uses a balancing capacitor, a center tap current transformer, a bridge circuit having two identical circuit legs, a differential amplifier, an error signal generating circuit, an operational amplifier, and voltage and current generator circuitry consisting of an oscillator, two transformers, MOS driver transistors and a filter circuit. Currents in the primary winding of the transformer caused by parasitic capacitance of the reactor and by the balancing capacitor effectively cancel each other out. This results in a voltage signal generated by the bridge circuit, which is coupled to the secondary winding of the transformer, that is proportional only to current flowing through the r. f. glow discharge reaction. This voltage signal is compared by the error signal generating circuit with a reference voltage which is proportional to a desired current level through the r. f. glow discharge reaction. The difference between the potential levels of the bridge generated voltage signal and the reference voltage is used to generate an error signal which changes an output voltage of the voltage and current generator circuitry so as to keep current flow through the r. f. glow discharge reaction essentially constant.

16 Claims, 4 Drawing Figures

R. F. GLOW DISCHARGE CONSTANT CURRENT SOURCE

FIELD OF THE INVENTION

This invention relates to constant current circuitry for maintaining a constant current through a load element and in particular to circuitry for maintaining a constant current flow through an r. f. (radio frequency) glow discharge reaction which has varying impedance.

BACKGROUND OF THE INVENTION

U.S. patent application Ser. No. 822,457, entitled "Process And Apparatus For Analyzing A Gaseous Mixture And A Visible Emission Spectra Generator Therefor," filed Jan. 17, 1986, has a common assignee with present invention and is directed to a process and apparatus for measuring trace amounts of a gas in a gaseous mixture, and to a visible emission spectra generator for gaseous mixtures. The apparatus comprises a chamber for receiving the gas to be analyzed and having electrodes positioned externally about the chamber and longitudinally disposed with respect to one another. An r. f. energy source connected to the electrodes causes an r. f. glow discharge reaction and resulting r. f. current there between. This generates a visible emission spectra of the gaseous mixture to be analyzed. The chamber is a glass tube with spaced apart electrodes disposed about the outside thereof. A photodetector is disposed proximate the chamber and detects light generated or a visible emission spectra. The process and apparatus also include a data processing device for evaluating spectral signals received by the photo detector device and suitable display and/or recording assemblies. The total current (Itot) drawn during an r. f. glow discharge reaction comprises a first component (Il) which flows through the r. f. glow discharge reaction and a second component (Is) which flows through stray capacitance between the electrodes. It is necessary to keep Il essentially constant to obtain accurate data. Keeping Itot constant does not necessarily keep Il constant.

It is desirable in some applications to provide apparatus for maintaining essentially constant current through an r. f. glow discharge reaction housed in a chamber in the presence of parasitic (stray) capacitance between electrodes of the chamber which also draws current.

SUMMARY OF THE INVENTION

The present invention is directed to apparatus for keeping current flowing through an r. f. glow discharge reaction occurring in a chamber (reactor) essentially constant even if there are variations in the load impedance presented by the r. f. glow discharge reaction and in the presence of parasitic impedance between spaced apart electrodes of the chamber. The apparatus essentially comprises a balancing element having an impedance essentially equal to the parasitic impedance, a first circuit means for generating an output signal which is proportional to current flowing only through the load impedance, an error signal generating means for comparing an output signal of the first circuit means with a reference signal and generating an error signal representative of the difference between signals, and power generating means responsive to the error signal for generating a potential level which results in an essentially constant current flow through the load impedance. The first circuit means is coupled to the balancing element and is adapted to be coupled to the load element. The error signal generating means is coupled to the first circuit means and is adapted to generate a reference signal which is proportional to a desired level of current flow through the r. f. glow discharge reaction. The power generating means is coupled to the error signal generating means and is adapted to be coupled to the r. f. glow discharge reaction.

In a typical embodiment the chamber (reactor) is a glass tube with spaced apart metallic electrodes surrounding the outside of the tube. An r. f. glow discharge reaction occurs within the tube between the two electrodes. The balancing element is a capacitor which has the same value as parasitic capacitance between the electrodes of the reactor. The first circuit means comprises a current transformer, which has primary and secondary windings each having end terminals, a two input terminal differential amplifier, and a bridge circuit with two legs which each essentially comprise a diode, a resistor, and a capacitor. The primary winding has a center tap terminal which is coupled to a first output terminal of the apparatus. The error signal generating means is essentially the series combination of two resistors with a common terminal thereof being where the error signal is generated. The resistors are coupled between two selected voltages. An oscillator circuit, two n-channel field effect transistors, a filter circuit, a voltage amplifier circuit and a tuned circuit serve as the power generating means. The oscillator circuit generates an a. c. signal which is coupled to the gate terminals of the same transistors. The error signal serves essentially as a d. c. bias coupled to the gates of two n-channel field effect transistors. This effectively varies the output voltage level of the power generating means.

Current which flows through the parasitic capacitance of the reactor is balanced by current flowing through the balance capacitor such that the output voltage of the bridge is zero with no load current. Current flowing through the load impedance of the r. f. glow discharge reaction causes an imbalance in the bridge that results in a voltage across the bridge that is directly proportional to the current flowing through the r. f. glow discharge reaction. This voltage is compared with a reference voltage by the two series resistors and an error signal is generated at a common terminal of the two resistors. The voltage output at the common terminal of the resistors causes a reduction in the biasing of the gates of the transistors if the current flow through the load is greater than the desired level. There is a corresponding increase in the biasing of the gates of the transistors if the converse is true. The level of d.c. biasing causes an output voltage of the apparatus to be modified appropriately so as to keep the load current flowing through the r. f. glow discharge reaction at an essentially constant level.

The present invention will be better understood from the subsequent more detailed description of an illustrative embodiment taken in conjunction with the accompanying drawings.

DETAILED DESCRIPTION

Figure 1:
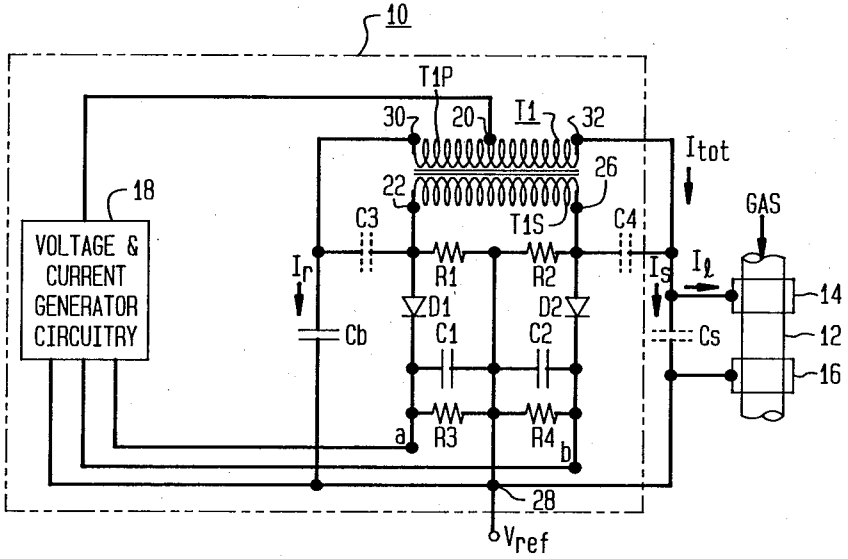
FIG. 1 shows in schematic and block diagram form one illustrative embodiment in accordance with the present invention.

Referring now to FIG. 1, there is shown within a dashed line rectangle a power supply-constant current source 10 in accordance with the present invention. Source 10 is shown connected by output terminals 28 and 32 thereof to first and second electrodes 16, and 14, respectively, of a glass tube 12. Only a part of tube 12 is shown with the arrow at the top near electrode 14 indicating the direction of gas flow through tube 12. A parasitic capacitance Cs, shown in dotted lines, exists between electrodes 14 and 16. Source 10 selectively provides a sufficient voltage and current between electrodes 14 and 16 to cause gas flowing through tube 12 to form an r. f. glow discharge within tube 12 between electrodes 14 and 16. It supplies a current Itot which has a first component Il which flows through tube 12 and supports the r. f. glow discharge reaction therein (the load impedance) and a second component Is which flows through Cs (the parasitic impedance). Il and Is may be referred to as the load current and parasitic (stray) current, respectively. Source 10 selectively acts to maintain Il essentially constant as the impedance between electrodes 14 and 16 varies as typically occurs during an r. f. glow discharge reaction or when there are gas composition changes.

Figure 2:
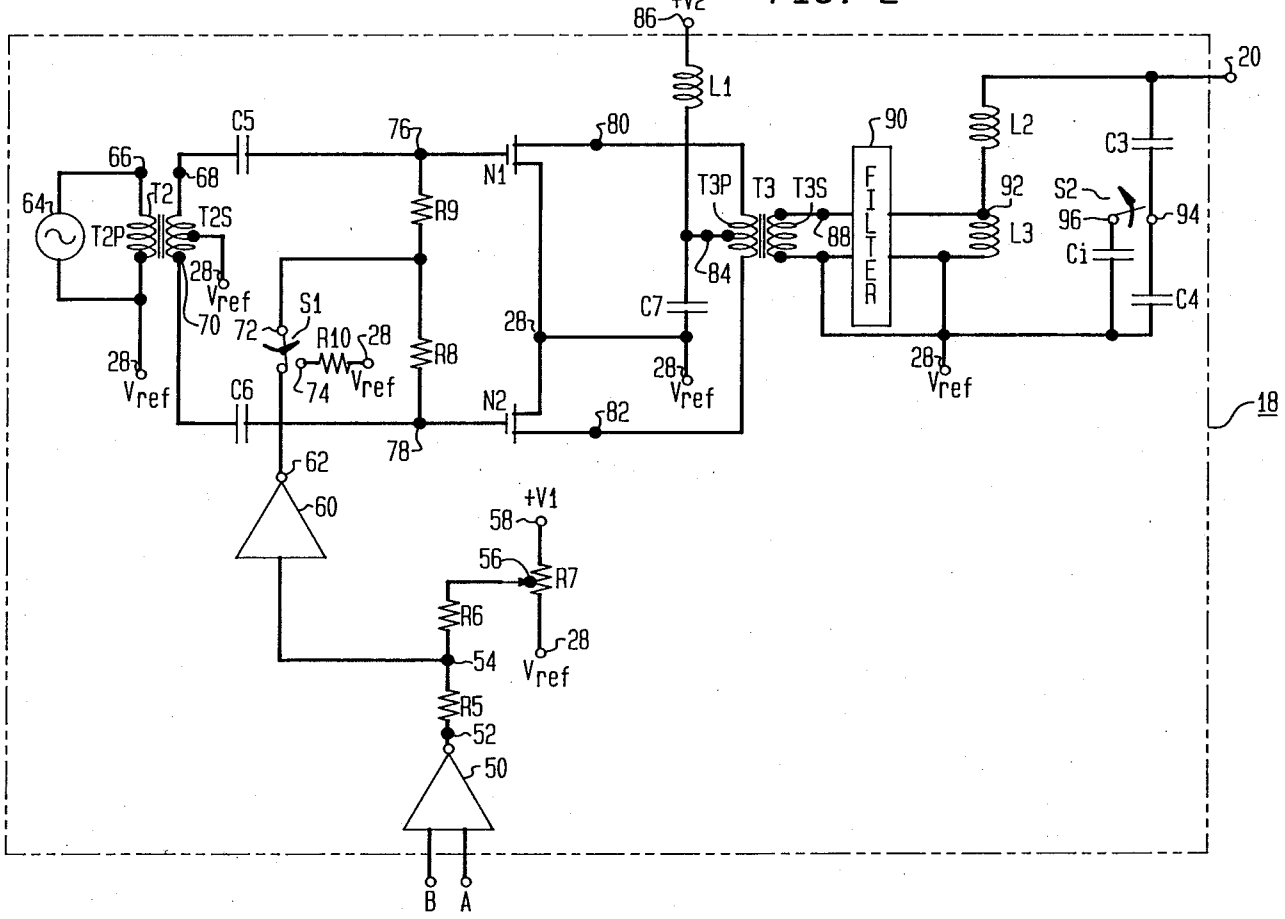
FIG. 2 shows in schematic and block diagram form details of a portion of the embodiment shown in FIG. 1.

Power supply-constant current source 10 comprises voltage and current generator circuitry 18, a center tap toroidal current transformer T1, a balance capacitor Cb (also denoted as a balancing element), first and second capacitors C1 and C2, and first, second, third, and fourth resistors R1, R2, R3 and R4, respectively. One detailed schematic embodiment of circuitry 18 is shown in FIG. 2. T1 has a primary winding T1P and a secondary winding T1S. T1P has a center tap terminal 20 which is coupled to circuitry 18, a left end terminal 30 which is coupled to a first terminal of Cb, and a right end terminal 32 which is coupled to electrode 14. T1S has a left side end terminal 22 which is coupled to an anode terminal of D1 and to a first terminal of R1 and has a right side end terminal 26 which is coupled to an anode terminal of D2 and to a first terminal of R2.

Between terminals 30 and 22 is shown in a dashed line parasitic capacitance C3 and between terminals 32 and 26 is shown in a dashed line a parasitic capacitance C4. A cathode terminal of D1 is coupled to first terminals of C1 and R3, to circuitry 18, and to a terminal a. A cathode terminal of D2 is coupled to first terminals of C2 and R4, to circuitry 18 and to a terminal b. Second terminals of Cb, R1, R2, R3, R4, C1 and C2, and electrode 16, are coupled to terminal 28 and to potential source Vref. Vref is typically ground potential. D1 and D2 serve as half wave rectifiers and C1 and C2 serve as filters. D1, D2, C1, C2, R3 and R4 serve as a two leg bridge circuit with the first leg comprising D1, R3 and C1 and the second leg comprising D2, R4 and C2. R1 and R2 are used to help ensure that T1 functions as a current transformer.

The value of Cb is selected as follows. The output voltage of circuitry 18, which appears between terminals 32 and 28, is set to a level (typically 200 volts a.c. or less) which is insufficient with gas flowing through tube 12 to cause a r. f. glow discharge reaction in tube 12. Cb is varied while the voltage between terminals a and b (Vab) is measured. Cb is varied until Vab=0. This means that the current (Is) flowing through Cs equals the current (Ib) flowing through Cb. D1 and D2 are selected to be the same type of diode and therefore have essentially identical voltage-current characteristics. C3 and C4 act to induce the same current flow into the secondary winding of T1 and therefore have essentially no affect on Vab since the current generated by C3 flows through D1 and the current created by C4 flows through D2. Accordingly, with equal currents flowing through D1 and D2, the voltages at terminals a and b are equal and of the same polarity. Thus Vab equals zero (0) volts.

When the voltage of circuitry 10 is increased sufficiently (typically 300 to 500 volts AC) to cause an r. f. glow discharge reaction in tube 12 between electrodes 14 and 16, the currents through Cb and Cs are equal and tend to cause the potentials of terminals a and b to be equal. There is an imbalance in the currents flowing through D1 and D2 caused by the load current Il drawn through tube 12. The voltage Vab is therefore only proportional to the load current Il.

Terminals a and b serve as input terminals of voltage and current generator circuitry 18. Voltage Vab serves to control the voltage applied to terminal 20 from circuitry 18. This in turn controls Il so as to maintain same at a preselected essentially constant level.

The combination of T1, D1, D2, R1, R2, R3, R4, C1 and C2 is useful by itself to indicate the current Il which flows through the load impedance of the r.f. glow discharge reaction which occurs in tube 12. A power supply (not illustrated) can be substituted for circuitry 18 to create an r.f. glow discharge reaction in tube 12 in place of circuitry 18. This power supply would not be coupled to terminals a and b. Once an r.f. glow discharge reaction is started in tube 12, voltage Vab is measured and the current flowing through the r.f. glow discharge reaction is then easily calculated. If the current level of Il is greater than the desired value, then the voltage of the power supply can be manually decreased until the value of Vab corresponds to the desired current level. If the current level of Il is less than desired then the voltage of the power supply can be increased until the value of Vab corresponds to the desired current level. Thus Il can be kept essentially constant.

Referring now to FIG. 2, there is shown an illustrative embodiment of the Voltage and Current Generator Circuitry 18 of FIG. 1 which comprises a two input terminal inverting differential amplifier 50, resistors R5, R6, R8, R9, and R10, potentiometer R7, a single input terminal operational amplifier 60, an oscillator circuit 64, transformers T2 and T3, capacitors Ci, C3, C4, C5, C6, and C7, inductors L1, L2, and L3, n-channel field effect (MOS) transistors N1 and N2, and a filter circuit 90. During the time an r. f. glow discharge reaction occurs within tube 12, the voltage and current necessary to start and to sustain the reaction is supplied by circuitry 18.

Circuitry 18 has input terminals coupled to terminals a and b and senses the difference in potential of these terminals. This difference in potential is proportional to the amount of current (Il) which flows through tube 12. The impedance of the r. f. glow discharge reaction in tube 12 can change with time or gas composition. This results in the impedance between electrodes 14 and 16 varying. This in turn causes the current (Il) flowing through tube 12 to change. In one application it is required that Il remain essentially constant even if the impedance of the reaction in tube 12 varies. Circuitry 18 serves to selectively modify the voltage applied to terminals 20 and 28 so as to keep the current flow II through tube 12 essentially constant. As the impedance of tube 12 varies, the voltage difference between terminals a and b varies and circuitry 18 senses this variation and modifies the voltage between terminals 20 and 28 so as to keep Il constant.

Terminals a and b serve as first and second input terminals of differential amplifier 50. An inverting output terminal 52 of 50 is coupled to a first terminal of R5. A second terminal of R5 is coupled to an input terminal of operational amplifier 60, to a first terminal of R6 and to a terminal 54. A second terminal of R6 is coupled to a wiper arm of a potentiometer R7 and to a terminal 56. A first terminal of R7 is coupled to a power supply +V1 and to a terminal 58. A second terminal of R7 is coupled to reference potential Vref and to terminal 28. A non-inverting output terminal 62 of amplifier 60 is shown coupled to one terminal of a switch S1. S1 can be coupled to terminal 62, as is shown, or can be instead coupled to a first terminal of R10 and to a terminal 74. When S1 is coupled to terminal 62, circuitry 18 operates to continuously vary the potentials of terminals 20 and 28 so as to keep the current flowing through an r. f. glow discharge reaction occurring in tube 12 between electrodes 14 and 16 essentially constant. S1 is coupled to terminal 74 during a calibration portion of the operation of source 18 to allow the value of Cb to be determined as will be explained later herein. During the time S1 is coupled to terminal 74 there is no r. f. glow discharge reaction occurring in tube 12 and therefor Il=0. At this time the only current flowing is Is through Cs and Ib through Cb. A fixed terminal of S1 is coupled to first terminals of R8 and R9 and to a terminal 72.

A second terminal of R9 is coupled to a first terminal of C5, to a gate terminal of N1, and to a terminal 76. A second terminal of R8 is coupled to a first terminal of C6, to a gate terminal of N2 and to a terminal 78. A second terminal of C5 is coupled to a first terminal of a secondary winding T2S of transformer T2 and to a terminal 68. A second terminal of C6 is coupled to a second terminal of T2S and to a terminal 70. A center tap terminal of T2S is coupled to Vref and to terminal 28. A first terminal oscillator circuit 64 is coupled to a first terminal of a primary winding T2P of transformer T2 and to a terminal 66. A second terminal of oscillator circuit 64 is coupled to a second terminal of T2P, to Vref and to terminal 28.

A drain terminal of N1 is coupled to a first terminal of a primary winding T3P of transformer T3 and to a terminal 80. A drain terminal of N2 is coupled to a second terminal of T3P and to a terminal 82. A center tap terminal of T3P is coupled to one terminal of L1, to a first terminal of C7 and to a terminal 84. A second terminal of C7 is coupled to the sources of N1 and N2, to terminal 28 and to Vref. A second terminal of L1 is coupled to a voltage source +V2 and to a terminal 86. A first terminal of a secondary winding T3S of transformer T3 is coupled to a first input terminal of filter 90 and to a terminal 88. A second terminal of T3S is coupled to a second input terminal of filter circuit 90, to Vref and to terminal 28. A first output terminal of filter circuit 90 is coupled to first terminals of L2 and L3 and to a terminal 92. A second output terminal of filter circuit 90 is coupled to second terminals of L3, Ci, C4, and T3S, to Vref and to terminal 28. First terminals of L2 and C3 are coupled to terminal 20. L2 and L3 are typically a single coil of wire with a tap in a segment thereof. A second terminal of C3 and a first terminal of C4 are coupled together to a terminal 94. A first terminal of Ci is coupled to a first terminal of S2 and to a terminal 96. An arm portion of a switch S2 is selectively coupled to terminal 94 during an initial start up of an r. f. glow discharge reaction in tube 12. It is then put in an open position as is shown.

The operation of circuitry 18 is as follows: S1 is placed in a calibrate mode by moving an arm of S1 to contact terminal 74 and leaving S2 open and not contacting terminal 94. This causes the gate terminals 76 and 78 of N1 and N2, respectively, to be set to a zero d. c. bias level. Oscillator 64 produces a sine wave signal of a preselected frequency which is coupled through T2 and C5 and C6 to the gate terminals of N1 and N2. C5 and C6 act as a. c. shorts but prevent the d. c. signal from amplifier 60 from being shorted to Vref. Portions of the sine wave bias on N1 and N2, respectively. Thus a varying potential is transmitted to terminals 80 and 82 of the primary winding T3P of transformer T3. These signals are transmitted through T3 to terminals 88 and 28. Filter 90 suppresses harmonics but passes the frequency of the sine wave and thus it is transmitted to terminals 20 and 28. L2 and L3 act to multiply the voltage of the signal applied to terminals 92 and 28. L2, L3, C3, and C4 act as a tuned circuit. Thus the a. c. signal, which has been amplified, is applied to terminals 20 and 28. The amplitude of this signal is selected such that with gas flowing in tube 12 an r. f. glow discharge reaction does not occur within tube 12. Current Ib flows from terminal 20 to terminal 30 and through Cb. Current Is flows from terminal 20 to terminal 32 and through Cs. Ib induces a corresponding current in the secondary winding T1S of T1 which flows to terminal 22 and then through R1 to terminal 28 and through D1 and the parallel combination of C1 and R3 to terminal 28. Is induces a corresponding current in TIS of T1 which flows from terminal 26 and then through R2 to terminal 28 and through D2 and then the parallel combination of C2 and R4 to terminal 28. R1 is selected to be equal to R2, C1 is selected to be equal to C2, and D1 and D2 are selected to essentially identical diodes. The voltage difference between terminals a and b is then measured. The value of Cb is then varied until Vab=0. Ib is known to now equal Is and Cb is known to equal Cs. D1, C1 and R3 serve as one leg of a bridge and D2, C2, and R4 serve as a second leg of the bridge. With Vab=0, the currents in both legs are known to be equal. Any imbalance in currents flowing in the legs results in Vab assuming a value other than zero. This imbalance is the result of Il which flows only when there is gas in tube 12 and S1 is coupled to terminal 62.

Now the arms of S1 and S2 are moved such that they now contact terminals 62 and 94, respectively. This causes the d. c. bias on the gates of N1 and N2 to be a function of the output voltage appearing at terminal 62 of amplifier 60 and causes the potential between terminals 20 and 28 to be higher than if S2 is not contacting terminal 94. As will become clear shortly, the potential of the gates of N1 and N2 increases such that N1 and N2 become biased on and cause a sine wave to be generated at terminals 80 and 82 which has a positive d. c. level. A sine wave generated at terminals 66 and 28 is coupled via T2 to terminals 68 and 70. Positive portions of the sine wave are a. c. coupled through C5 and is superimposed on the d. c. potential of terminal 76. This biases on N1 and causes the positive portion of the sine wave to be amplified and to appear at terminal 80. Negative portions of the sine wave are inverted at terminal 70 and a. c. coupled through C6 to the terminal 78 (the gate of N2). These portions of the sine wave have the d. c. potential of terminal 78 superimposed thereon and this signal biases on N2 which amplifies these portions of the sine wave and causes the amplified portions to appear at terminal 82. This amplified sine wave having a positive d. c. bias is transmitted via T3 to terminals 88 and 28.

Filter circuit 90 filters out harmonics from the sine wave and transfers same across filter circuit 90 to terminals 92 and 82. L2 and L3 serve to amplify the potential levels of the sine wave. This effectively causes the potential between terminals 20 and 28 to rise sufficiently to a level which initiates an r. f. glow discharge reaction in tube 12 as gas passes through tube 12. S2 is disconnected from terminal 94 soon after an r. f. glow discharge reaction is started. Itot flows from terminal 20 through T1P of T1 to terminal 32. Itot=Il+Is. Load current Il now flows from electrode 14, through the r. f. glow discharge reaction occurring in tube 12, through electrode 16, and into terminal 28. Current also flows in the reverse direction. Is flows from terminal 32, through Cs and to terminal 28 and in the reverse direction. Current induced in T1S of T1 from Is in T1P flows from terminal 22 through R1 and D1. Current induced in T1S from Itot in T1P flows from terminal 26 through R2 and D2. This causes the potential of terminal b to be different than that of terminal a because Ib effectively flows through D1 and Is+Il effectively flows through D2. Thus Vab no longer equals zero.

In one typical embodiment it is desired to maintain Il at a constant value of 30 ma. This produces a Vab of −2.0033 volts. With differential amplifier 50 set to have a gain of 3, the output voltage at terminal 52 becomes −6.01 volts. +V1, R5, R6, and R7 are selected such that the voltage at terminal 56 is +6.03 volts and the resulting voltage at terminal 54 (herein after denoted as the error signal) is positive at approximately +0.01 volts. With the gain of operation amplifier 60 selected to be 470, the voltage of terminal 62 is +4.7 volts and N1 and N2 are biased on and result in an a. c. signal appearing between terminals 80 and 82. This signal is passed through T3 and filter 90 and then amplified by L2 and L3 so that the voltage appearing between electrodes 14 and 16 is approximately 500 volts. This potential level is sufficient to maintain an r. f. glow discharge reaction in tube 12 between electrodes 14 and 16.

In this embodiment R1=R2=27 ohms, R3=R4=1,000 ohms, R5=R6=2,000 ohms, R7=500 ohms, R8=R9=1,000 ohms, R10=1,000 ohms, C1=C2=0.01 microfarads, C3=12.5 picofarads, C4=3.0 to 30 picofarads, C5=C6=0.1 microfarads, C7=100 microfarads, L1=2.7 microhenrys, L2=4.1 microhenrys, L3=0.2 microhenrys, transformer T1 has 5 turns on each side of the primary winding and 5 turns on the secondary winding, +V1=+15 volts d. c., +V2=+48 volts d. c., transformer T2 has 13 turns on the primary winding and 13 turns on each side of the secondary winding, transformer T3 has 12 turns on each side of the primary winding and 12 turns on the secondary winding, N3 is an n-p-n bipolar transistor, N1 and N2 are n-channel metal-oxide-silicon (MOS) transistors, cryl is a crystal having a natural frequency of oscillation of 13.56 MHz, differential amplifier 50 has a gain of 3, and operational amplifier 60 has a gain of 470.

The impedance of the r. f. glow discharge reaction within tube 12 varies. If the potential between electrodes 14 and 16 were kept constant, then current Il would vary. Source 18 varies the potential applied between terminals 20 and 28 so as to keep Il constant as the impedance of the r. f. glow discharge reaction varies. If, for example, the impedance of the reaction decreases, Il would tend to increase. This would result in Vab increasing. This in turn results in the potential in output terminal 52 of differential amplifier 50 increasing so as to become more negative. This results in a decrease in the potential of terminal 54 which in turn results in a decrease in the potential of terminal 60. The potentials of terminals 76 and 78, the gates of N1 and N2, respectively, likewise decrease since they are resistivity coupled to terminal 62. This in turn lowers the d. c. level of the a. c. signal appearing across terminals 80 and 82. This in turn lowers the output signal voltage level appearing across terminals 20 and 28 and therefore across electrodes 14 and 16. As a result, the current (Il) flowing through the reaction in tube 12 is kept at an essentially constant preselected level.

If the impedance of the reaction within tube 12 increases, then Il tends to decrease. Circuitry 18 reacts to a decrease in the level of Il by increasing the voltage applied to terminals 20 and 28 so as to increase the voltage applied to electrodes 14 and 16 in order to increase Il. Circuitry 18 thus operates to automatically increase or decrease the voltage applied to terminals 20 and 28 so as to keep Il at a constant value independent of the impedance of the r. f. glow discharge reaction occurring within tube 12

Figure 3:
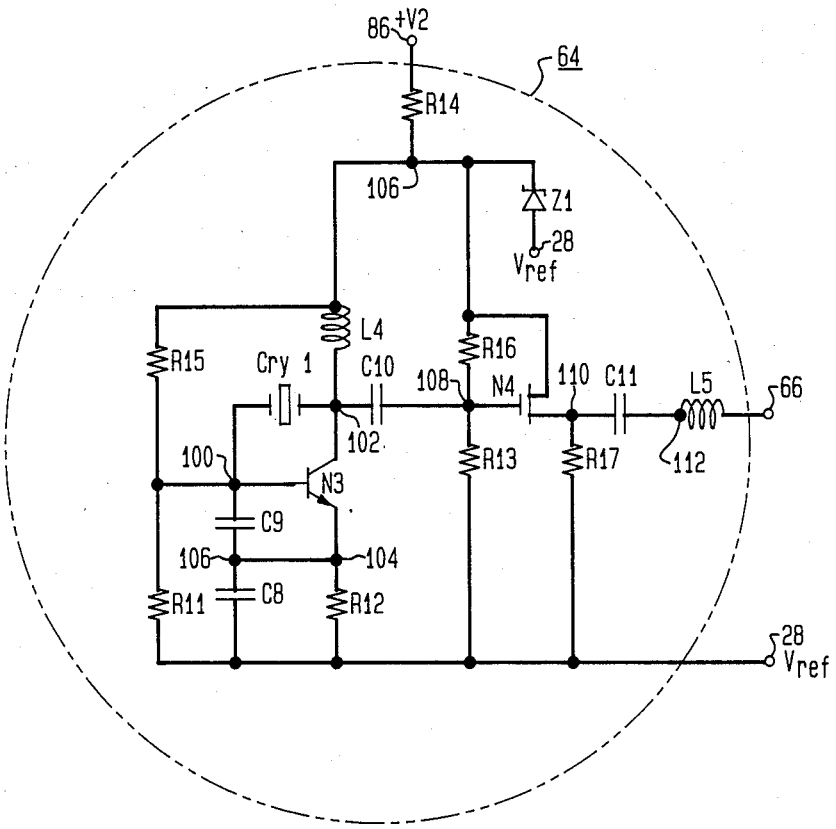
FIG. 3 shows in schematic form details of another portion of the embodiment of FIG. 2.

Referring now to FIG. 3, there is shown with the dashed line circle an illustrative embodiment of oscillator circuit 64 of FIG. 2 which comprises n-p-n transistor N3, n-channel field effect transistor N4, crystal Cry 1, resistors R11, R12, R13, R14, R15, R16 and R17, capacitors C8, C9, C10, and C11, inductors L4 and L5, and zener diode Z1.

The base of N3 is coupled to first terminals of Crs 1, R11, R15 and C9 and to a terminal 100. The emitter of N3 is coupled to first terminals of C8 and R12, to a second terminal of C9 and to a terminal 104. Second terminals of C8, R12, R13, R17 and Z1 are coupled to Vref and to terminal 28. The collector of N3 is coupled to first terminals of L4 and C10, to a second terminal of Cry 1, and to a terminal 102. A second terminal of L4 is coupled to a first terminal of R14, to a second terminal of R15, to a cathode terminal of Z1, to a drain terminal of N4, to a first terminal of R16 and to a terminal 106. A second terminal of R14 is coupled to +V2 and to terminal 86. Second terminals of C10 and R16 are coupled to a first terminal of R13, to a gate terminal of N4 and to a terminal 108. A source terminal of N4 is coupled to first terminals of C11 and R17 and to a terminal 110. A second terminal of C11 is coupled to a first terminal of L5 and to a terminal 112. A second terminal of L5 is coupled to terminal 66.

In one embodiment Cry 1 has a natural frequency of oscillation of 13.56 mHz, oscillator circuit 64 produces a sine wave output signal between terminals 66 and 28 having a frequency of 13.56 mHz and having a peak to peak amplitude of approximately the magnitude of the break down voltage of Z1 (the zener diode voltage), C8=0.05 microfarads, C9=270 picofarads, C10=0.1 microfarads, C11=37–250 picofarads, L4=10 millihenrys, L5=2.3 millihenrys, R11=1,000 ohms, R12=330 ohms, R13=4,700 ohms, R14=54 ohms, R15=8,200 ohms, R16=4,300 ohms, and R17=50 ohms.

Figure 4:
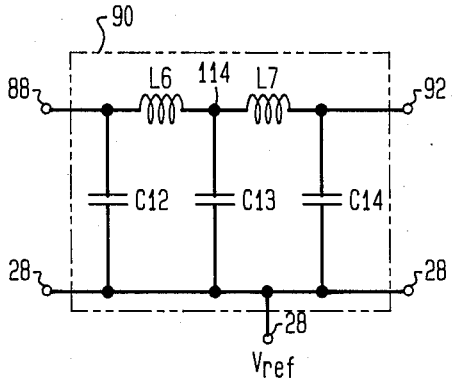
FIG. 4 shows in schematic form details of still another portion of the embodiment FIG. 2.

Referring now to FIG. 4, there is shown within the dashed line rectangle an illustrative embodiment of filter circuit 90 of FIG. 2 which comprises capacitors C12, C13, and C14, and inductors L6 and L7. In one embodiment the values of capacitors and inductors of filter circuit 90 are selected such that filter circuit 90 suppresses harmonics and passes a 13.56 MHz a. c. signal. C12 has a first terminal coupled to a first terminal of L6 and to terminal 88. L6 has a second terminal coupled to first terminals of L7 and C13 and to a terminal 114. A second terminal of L7 is coupled to a first terminal of C14 and to terminal 92. Second terminals of C12, C13, and C14 are coupled to Vref and to terminal 28. In a typical embodiment C12=C13=C14=220 picofarads and L6=L7=0.35 microhenrys.

It is to be understood that the embodiments described herein are merely illustrative of the general principles of the invention. Various modifications are possible within the scope of the invention. For example, a wide variety of different oscillator circuits and filter circuits can be used. Still further, switch S1 can be a mechanical switch or can be an electrical switch such as field effect or bipolar transistor. Still further, a wide variety of different bridge circuits can be used. Further more, N1, N2, N3 and N4 could be different types of transistors than those shown.

What is claimed is:

1. Apparatus coupled to a load device having a load impedance and a parasitic impedance associated therewith comprising:

a balancing element having an impedance essentially equal to the parasitic impedance;

first circuit means, which is coupled to the balancing element and to the load device, for generating an output signal which is proportional to current flowing only through the load impedance;

error signal generating means, which is coupled to an output terminal of the first circuit means and to a reference signal having a level which is proportional to a desired level of current flow through the load impedance, for comparing the output signal of the first circuit means with the reference signal and generating an error signal representative of the difference of the two signals; and power generating means, which is coupled to the error signal generating means and to the load device and is responsive to the error signal, for generating a potential level(s) which selectively results in an essentially constant current flow through the load impedance.

2. The apparatus of claim 1 wherein:

the first circuit means comprises a first transformer having primary and secondary windings with each of the windings having first and second end terminals and the primary winding having a center tap terminal, the first and center tap terminals of the primary winding being coupled to the balancing element and the power generating means, respectively;

the first circuit means further comprises a bridge circuit having first and second circuit legs, the first circuit leg being coupled between the first end terminal of the secondary winding and the error generating signal means, and the second circuit leg being coupled between the second end terminal of the secondary winding and the error generating signal means;

the apparatus having first and second output terminals, the second output terminal of the primary winding being coupled to the first output terminal of the apparatus; and the first and second output terminals of the apparatus being coupled to first and second electrodes, respectively, of the load element.

3. The apparatus of claim 2 wherein:

the first leg circuit comprises a first diode having anode and cathode terminals, a first resistor having first and second terminals and a first capacitor having first and second terminals;

the second leg circuit comprises a second diode anode and cathode terminals, a second resistor having first and second terminals and a second capacitor having first and second terminals;

anode terminals of the first and second diodes are coupled to the first and second end terminals, respectively, of the secondary winding of the first transformer;

a cathode terminal of the first diode is coupled to first terminals of the first resistor and the first capacitor and to the error generating signal means;

a cathode terminal of the second diode is coupled to first terminals of the second resistor and the second capacitor and to the error generating signal means; and second terminals of the first and second resistors and the first and second capacitors are coupled together.

4. The apparatus of claim 3 wherein:

the first circuit means further comprises a differential amplifier having first and second input terminals and an inverting output terminal; and the cathode terminal of the first diode is coupled to the first terminal of the differential amplifier;

the cathode terminal of the second diode is coupled to the second input terminal of the differential amplifier; and the inverting output terminal of the differential amplifier is coupled to the error generating signal means.

5. The apparatus of claim 4 wherein:

the error signal generating means further comprises third and fourth resistors;

a first terminal of the third resistor is coupled to the inverting output terminal of the differential amplifier;

a second terminal of the third resistor is coupled to a first terminal of the fourth resistor; and a second terminal of the fourth resistor is connectable to a first potential source.

6. The apparatus of claim 5 wherein:

the error signal generating means further comprises an operational amplifier having an input terminal and a non-inverting output terminal; and the input and output terminals of the operational amplifier being coupled to the second terminal of the third resistor and to the power generating means, respectively.

7. The apparatus of claim 6 wherein the power generating means comprises:

an oscillator circuit having output terminals;

first and second switching devices each having a control terminal and first and second output terminals;

fifth and sixth resistors;

the output terminal of the operational amplifier being coupled to first terminals of the fifth and sixth resistors;

a second terminal of the fifth resistor being coupled to the control terminal of the first switching device and to a first output terminal of the oscillator circuit; and a second terminal of the sixth resistor being coupled to the control terminal of the second switching device and to a second output terminal of the oscillator circuit.

8. The apparatus of claim 7 where the oscillator circuit is coupled to the control terminals of the first and second switching devices through a second transformer having a secondary winding having first and second end terminals and having a center tap terminal.

9. The apparatus of claim 8 wherein the power generating means further comprises:

first and second terminals of a third capacitor being coupled to the first terminal of secondary winding of the second transformer and to the control terminal of the first switching device, respectively; and first and second terminals of a fourth capacitor being coupled to the second terminal of the secondary winding of the second transformer and to the control terminal of the second switching device, respectively.

10. The apparatus of claim 9 wherein the power generating means further comprises:

a third transformer having a primary winding having first and second end terminals and a center tap terminal and having a secondary winding having first and second end terminals;

a first inductor having first and second terminals;

a fifth capacitor having first and second terminals;

the first output terminals of the first and second switching devices being coupled to the first and second end terminals, respectively, of the primary winding of the third transformer;

the center tap terminal of the primary winding of the third transformer being coupled to the first terminals of the first inductor and the fifth capacitor;

the first terminal of the first inductor being connectable to a second potential source; and the second terminal of the fifth capacitor being coupled to the second output terminals of the first and second switching devices.

11. The apparatus of claim 10 wherein the power generating means further comprises:

a filter circuit having first and second input terminals and first and second output terminals;

second and third inductors and six and seventh capacitors each having first and second terminals;

the first and second end terminals of the secondary winding of the third transformer being coupled to first and second input terminals, respectively, of the filter circuit;

the first output terminal of the filter circuit being coupled to first terminals of the second and third inductors;

the second output terminal of the filter circuit being coupled to the second terminals of the second inductor and sixth capacitor and to the second output terminal of the apparatus;

the second output terminals of the third inductor and the seventh capacitor being coupled to the center tap terminal of the primary winding of the first transformer; and the first output terminal of the seventh capacitor being coupled to the first output terminal of the sixth capacitor.

12. The apparatus of claim 11 further comprising:

a seventh resistor having first and second end terminals with the first terminal coupled to the first terminal of the secondary winding of the first transformer;

an eighth resistor having first and second end terminals with the first terminal of coupled to the second terminal of the second winding of the first transformer; and second terminals of the seventh and eighth resistors being coupled to second terminals of the first and second resistors and to the second terminals of the first and second capacitors.

13. The apparatus of claim 12 further comprising:

a third switch having a first terminal coupled to first terminals of the fifth and sixth resistors;

a ninth resistor having first and second terminals;

a second terminal of the third switch being adapted to be coupled to the output terminal of the operational amplifier or to the first terminal of the ninth resistor; and the second terminal of the ninth resistor being coupled to the second output terminal of the apparatus.

14. The apparatus of claim 13 further comprising:

a potentiometer having first first and second terminals and a movable third terminal;

the third terminal of the potentiometer being coupled to the second terminal of the fourth resistor;

the first terminal of the potentiometer being connectable to the first potential source; and the second terminal of the potentiometer being coupled to the second output terminal of the apparatus.

15. The apparatus of claim 14 further comprising:

a fourth switching device having a control terminal and first and second output terminals;

an eight capacitor having first and second terminals with the first and second terminals coupled to the second terminal of the sixth capacitor and to the first output terminal of the fourth switching device, respectively; and the first output terminal of the fourth switching device being selectively coupled to the first terminals of the six and seventh capacitors.

16. Apparatus coupled to a load device having a load impedance and a parasitic impedance associated therewith comprising:

a balancing element having an impedance essentially equal to the parasitic impedance;

a first transformer having primary and secondary windings with each of the windings having first and second end terminals and the primary winding having a center tap terminal, the first end terminal of the primary winding being coupled to the balancing element and the second end terminal of the primary winding being coupled to the load device;

a differential amplifier having first and second input terminals and an output terminal;

a bridge circuit having essentially identical first and second circuit legs, the first circuit leg being coupled between the first end terminal of the secondary winding and the first input terminal of the differential amplifier and the second leg circuit being coupled between the second end terminal of the secondary winding and the second input terminal of the differential amplifier;

error signal generating means, which is coupled to an output terminal of the differential amplifier and to a reference signal having a level which is proportional to a desired level of current flow through the load impedance, for comparing the output signal of the first circuit means with the reference signal and generating an error signal representative of the difference of the two signals; and power generating means, which is coupled by a control terminal to the error signal generating means and is coupled by an output terminal thereof to the center tap terminal of the primary winding and is responsive to the error signal, for generating a potential level(s) which results in an essentially constant current flow through the load impedance.

* * * * *